US005461974A

United States Patent [19]

Reneau

[11] Patent Number: 5,461,974

[45] **Date of Patent: * Oct. 31, 1995**

[54] WORKSTATION WITH INTEGRATED COMPUTER

[76] Inventor: Raymond P. Reneau, 701 N. St. Mary's St., #27, San Antonio, Tex. 78205

[ * ] Notice: The portion of the term of this patent subsequent to Dec. 21, 2010, has been disclaimed.

[21] Appl. No.: 167,784

[22] Filed: Dec. 15, 1993

Related U.S. Application Data

[63] Continuation-in-part of Ser. No. 746,908, Aug. 19, 1991, Pat. No. 5,271,320.

[51] Int. Cl.[6] ..... A47B 9/00

[52] U.S. Cl. ..... 108/147; 108/150

[58] Field of Search ..... 108/147, 7, 50, 108/144, 105, 95, 96; 248/188.5, 188.1, 916–920

[56] References Cited

U.S. PATENT DOCUMENTS

| | | | |
|---|---|---|---|
| 4,852,500 | 8/1989 | Ryburg et al. | 108/50 X |
| 5,024,167 | 6/1991 | Hayward | 108/50 |
| 5,101,736 | 4/1992 | Bommarito et al. | 108/147 X |
| 5,220,871 | 6/1993 | Grund et al. | 108/50 |
| 5,224,429 | 7/1993 | Borgman et al. | 108/50 X |
| 5,226,705 | 7/1993 | Rorke et al. | 108/50 X |
| 5,271,320 | 12/1993 | Reneau | 108/147 |
| 5,322,025 | 6/1994 | Sherman et al. | 108/147 |
| 5,339,750 | 4/1994 | Smies | 108/147 |

*Primary Examiner*—Jose V. Chen
*Attorney, Agent, or Firm*—Richard L. Schwartz

[57] ABSTRACT

A new and improved workstation including a base member, a first vertical mast mounted with the base member and extending upwardly therefrom, a second vertical mast disposed about the first vertical mast for vertical movement with respect thereto, a monitor shelf with the second vertical mast for movement therewith, a third vertical mast disposed about the second vertical mast for movement therewith, a work surface with the third vertical mast for movement therewith, and computing structure integrally mounted therewith.

25 Claims, 7 Drawing Sheets

WORKSTATION WITH INTEGRATED COMPUTER

CROSS REFERENCES TO RELATED APPLICATIONS

This application is a continuation-in-part of U.S. patent application Ser. No. 07/746,908, filed Aug. 19, 1991, now U.S. Pat. No. 5,271,320, issued Dec. 21, 1993.

FIELD OF THE INVENTION

The field of this invention relates to workstations, particularly of the type that are designed to be used in connection with computer environments.

BACKGROUND OF THE INVENTION

The computer workstation has evolved from a simple desk structure to one that incorporates features designed to accommodate various types of computers and computer components, all useful in business and industry. As the demands for computer utilization increase, the ability for a computer operator to work extended periods of time at a computer workstation becomes an item of greater interest.

In order to appropriately define a computer workstation environment, an evaluation of human engineering, i.e., ergonomic factors, must be met in order for a workstation to satisfy extended use requirements. The human engineering design requirements for the operators of large, multiple-operator systems and individual freestanding stations typically involve many similar ergonomic considerations.

In the context of a personal computer workstation, an individual workstation environment typically must include a total system—that is, a computer (a central processing unit), monitor(s), keyboard (and other input devices) and printers/plotters (and other output devices) in immediate proximity to one another as distinguished from the large main frame designs wherein the central processing unit, disk storage device and printers are ordinarily mounted remote from the user's workstation.

In order to properly define the workstation environment, ergonomic considerations having to do with the correct or desired line-of-sight from the operator to the monitor, ease of operator work surface adjustment in terms of height, distance and tilt adjustments for input devices (i.e., keyboards/mouse) and displays, ease of operator access to system components, glare-free viewing of the monitor(s) (i.e., cathode ray tubes) and proper work surface lighting dictate primary considerations for a "user-friendly" workstation.

Prior art devices have offered variations of conventional desks or stands with shelves. Articulating arms have been used in the past for positioning of the individual monitors. Indeed, some devices address separation of the work surface and the monitor surface, while other devices deal with adjustable vertical surfaces for selective positioning of the work surface and the monitor surfaces. Other structures have the capability of horizontally adjusting the monitor position with respect to the user. In some cases, tilting surfaces have been incorporated for adjusting the keyboard (input device) angle and permitting some tilting of work surface to accommodate user preferences. To a more limited extent, some prior art devices permit certain ranges of customer adjusting to accommodate the various component pieces of a user's workstation. So far as known, no attempt has been made to incorporate lighting directly into the workstation so as to provide appropriate workstation lighting. Some prior art devices have detailed the utilization of multiple adjacent pedestal designs to accommodate elevational variations in the work surfaces of the user and that of the monitor display stand.

However, so far as known, no workstation is known to be capable of effectively, in a single coordinated unit, dealing effectively with multiple ergonomic requirements while providing a workstation having an easily adjustable, compact, user-friendly design complete with an integrated computer therewith.

SUMMARY OF THE INVENTION

The present invention relates to a new and improved, fully-integrated computer workstation capable of addressing the essential human engineering factors in a single workstation for ease of operator operation, including a vertically adjustable monitor shelf, a vertically adjustable work surface, the work surface capable of being tilted to a user-desired angle, the monitor shelf being horizontally movable, an integrated computer therewith, and all being compatibly incorporated into a single unit.

DESCRIPTION OF THE PREFERRED EMBODIMENT

Figure 1:
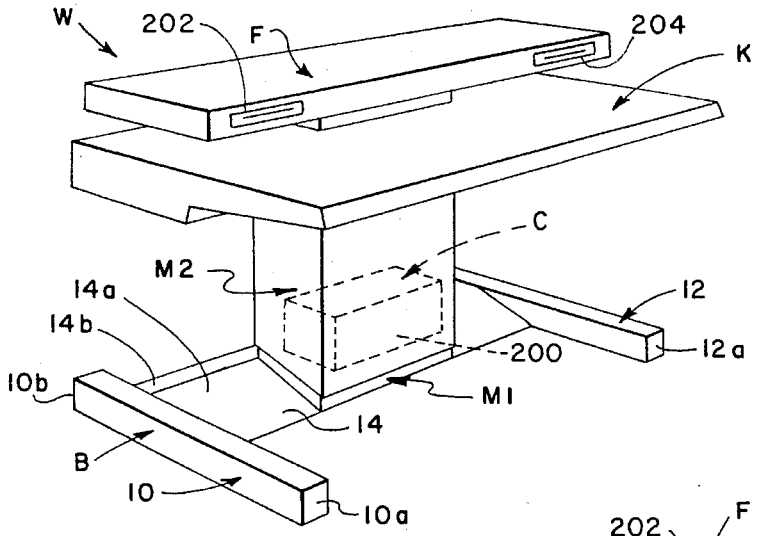
FIG. 1 is an elevational perspective view of the workstation of the present invention showing the monitor shelf and work surface in their respective lowermost, horizontal positions.

The present invention relates to a new and improved workstation designated generally as W adapted to be used in the working environment of a singular computer per operator, as in a personal computer workstation, or an individual station in a computer network. The workstation W is particularly well suited for use in connection with computer-aided graphics, for example in design and manufacturing applications (however not so limited). The workstation W generally includes a base member B, first, second, third vertical masts M1, M2, M3, respectively, a monitor shelf F and a work surface K. Like numerals and letters designate like component parts amongst the various drawings.

The workstation W includes a base member B having base legs 10, 12 joined by cross member 14 which permits the base legs 10, 12 to be maintained in a substantially parallel relationship with respect to one another. The cross member 14 preferably is formed having a foot rest surface 14*a* and flat surface 14*b* on the upper surface thereof, preferably extending the full length of the cross member 14 between base legs 10, 12. Preferably each of the base legs 10, 12 has a forward end 10*a*, 12*a* and a rearward end 10*b*, 12*b* , with the cross member 14 being positioned between the base legs 10, 12 such that the flat surface 14*b* and its adjacent rear surface 14*c* (FIG. 4) are in proximity to rearward ends 10*b*, 12*b* of the base legs 10, 12, respectively. Preferably, the base member B further is formed having a suitable opening 16 formed in the upper surfaces of the cross member 14, most notably in the foot rest surface 14*a* and flat surface 14*b*, the opening 16 receiving the first vertical mast M1. As depicted in the drawings, the opening 16 is preferably of a generally rectangular configuration, however as may be appreciated, the opening 16 may be square, elliptical, circular or any other configuration so as to conform to the external configuration of the first vertical mast M1 as discussed more fully hereinbelow.

Figure 5:
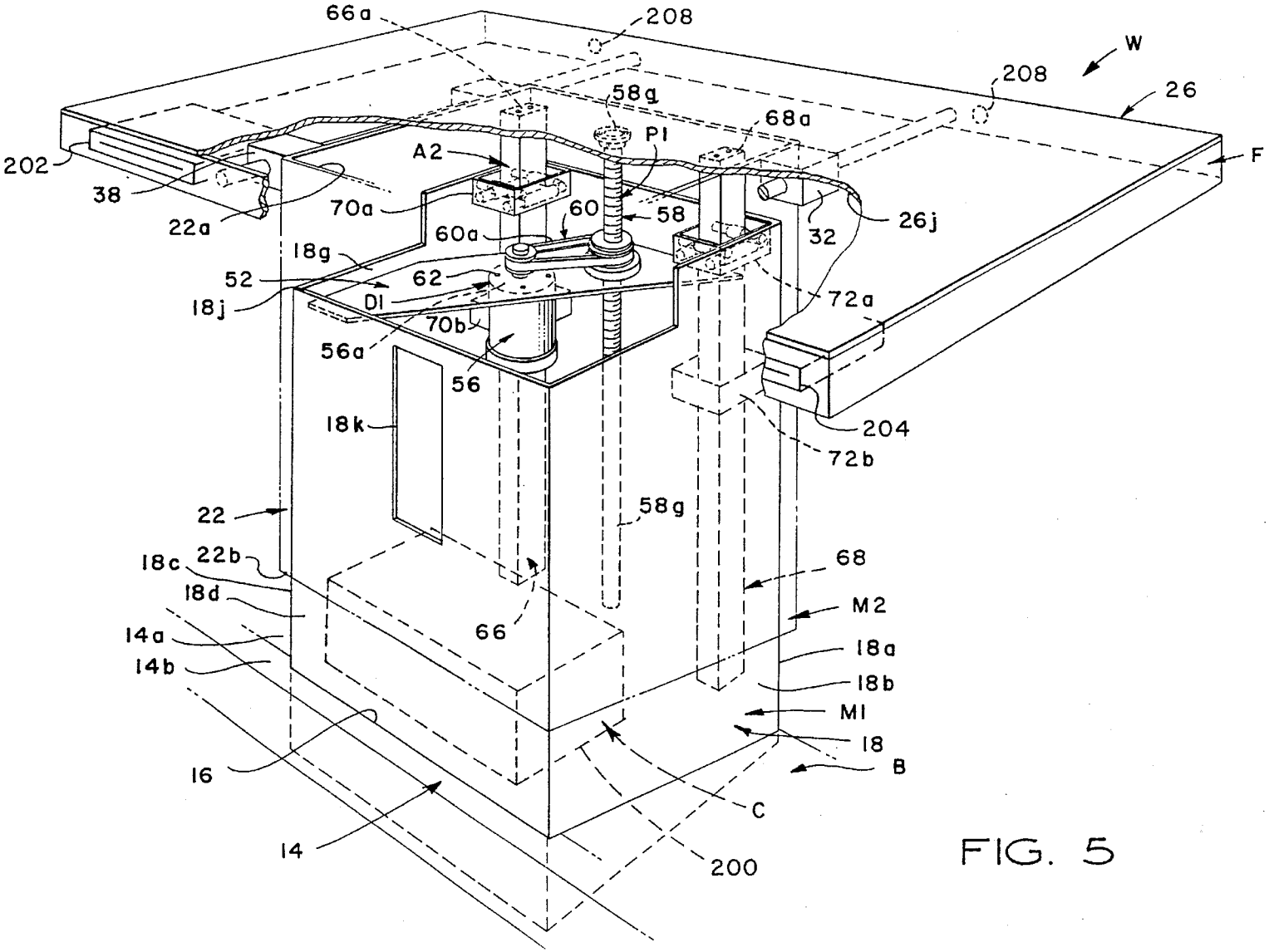
FIG. 5 is an elevational perspective view of a portion of the workstation of the present invention, partly in section, partly in cutaway and partly in phantom, detailing the drive means for the second vertical mast of the present invention.
Figure 6:
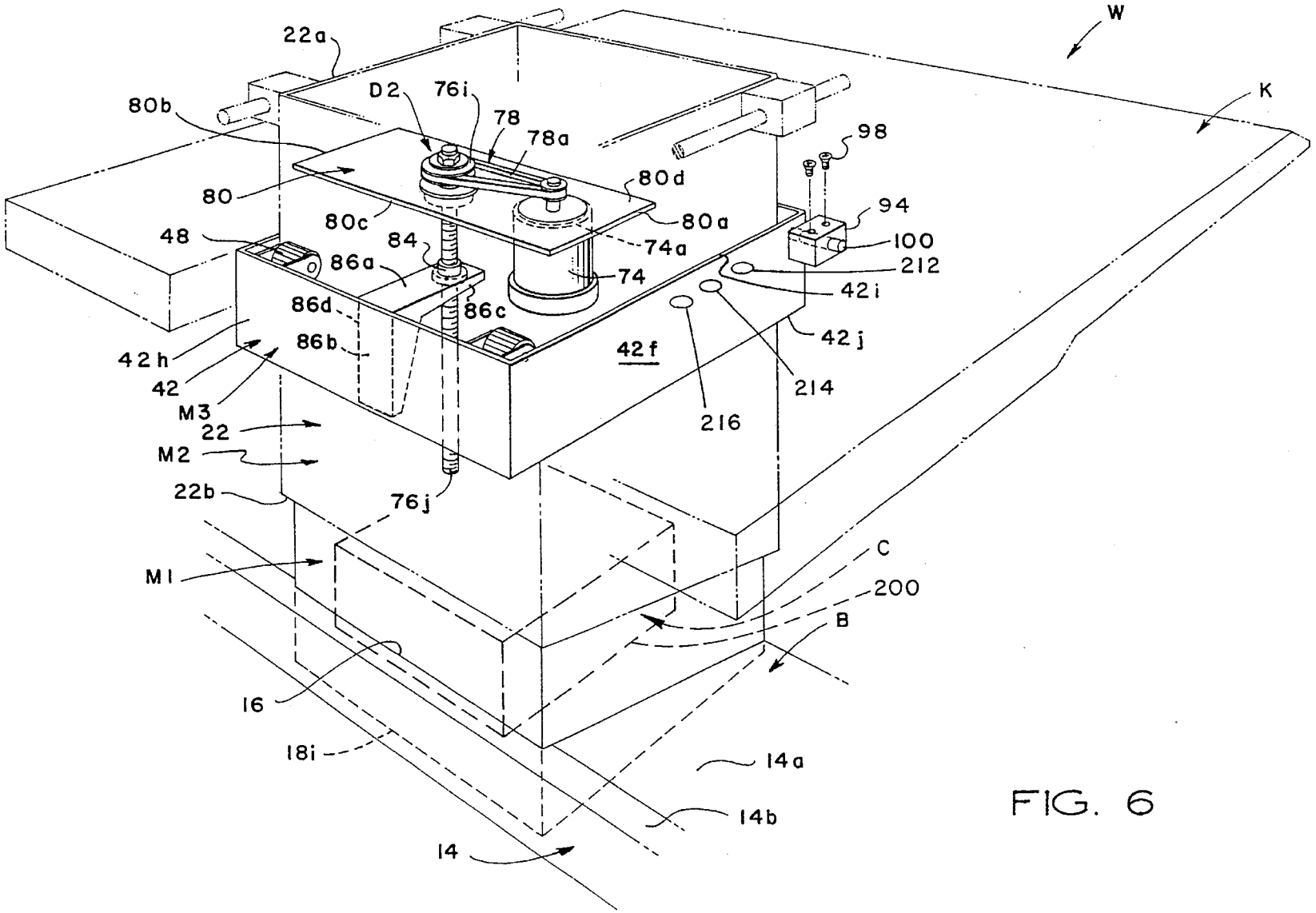
FIG. 6 is an elevational perspective view of the workstation of the present invention, partly in section, partly in cutaway, partly in phantom, detailing the drive means for the third vertical mast of the present invention.

The workstation W of the present invention further includes a first vertical mast M1 mounted with the base member B and extending upwardly therefrom. The first vertical mast M1 includes mast 18, which is best seen in FIG. 5 and FIG. 6. The mast 18 includes mast sides 18*a*, 18*b*, 18*c*, 18*d* which define the outer exterior surface thereof (FIG. 7), with interior surfaces 18*e*, 18*f*, 18*g*, 18*h* defining the outer boundaries of an inner cavity 20 formed within mast 18.

Preferably the lower surface 18*i* of the mast 18 of the first vertical mast M1 rests on the same floor structure that the base member B rests upon, with the mast 18 being disposed within the opening 16 formed in the cross member 14 and the first vertical mast M1 extending upwardly therefrom. Preferably, the first vertical mast M1 is positioned equidistant between the base legs 10, 12 and intermediate of the cross member 14 with the longitudinal axes of the first vertical mast M1 being equidistant between such base legs 10, 12. The first vertical mast M1 extends upwardly from the base member B and terminates at upper surface 18*j*. As discussed more fully hereinbelow, mast side 18*d* is formed having a rectangular opening 18*k* which extends between the mast side 18*d* and inner surface 18*h*.

The workstation W of the present invention further includes a second vertical mast M2 adapted to be disposed about the first vertical mast M1 for vertical movement with respect thereto. The second vertical mast M2 includes mast 22 having an upper end surface 22*a* and a lower end surface 22*b*. The outer side portions 22*c*, 22*d*, 22*e*, 22*f* (FIG. 7) form the outer perimeter surfaces of the mast 22, with the inner side portions 22*g*, 22*h*, 22*i*, 22*j* forming the interior perimeter surface of the mast 22. Preferably a cavity 24 is formed between surfaces 22*f*, 22*j* for alignment with cavity 20 (FIG. 4) as discussed more fully hereinbelow.

Figure 2:
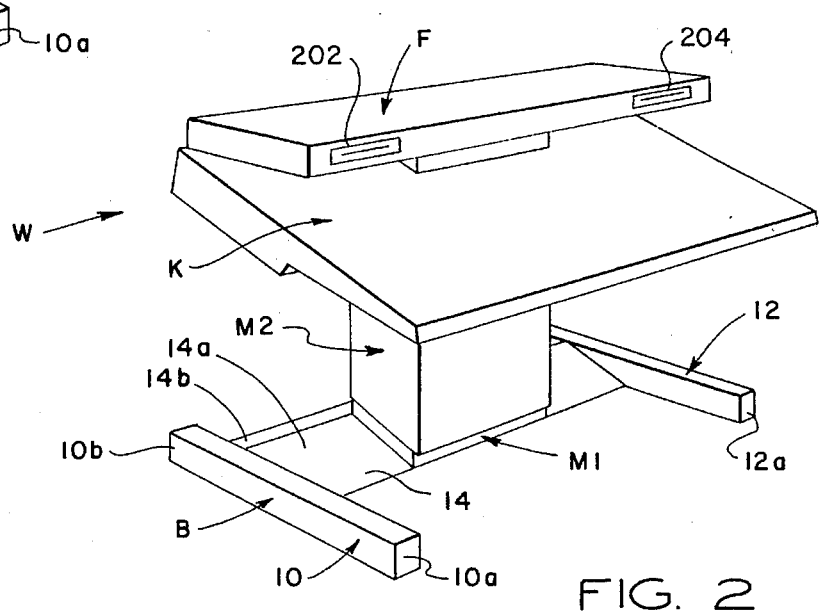
FIG. 2 is an elevational perspective view of the workstation of the present invention, similar to that shown in FIG. 1, depicting the work surface in a non-horizontal, tilted relation with respect to the monitor shelf.
Figure 3:
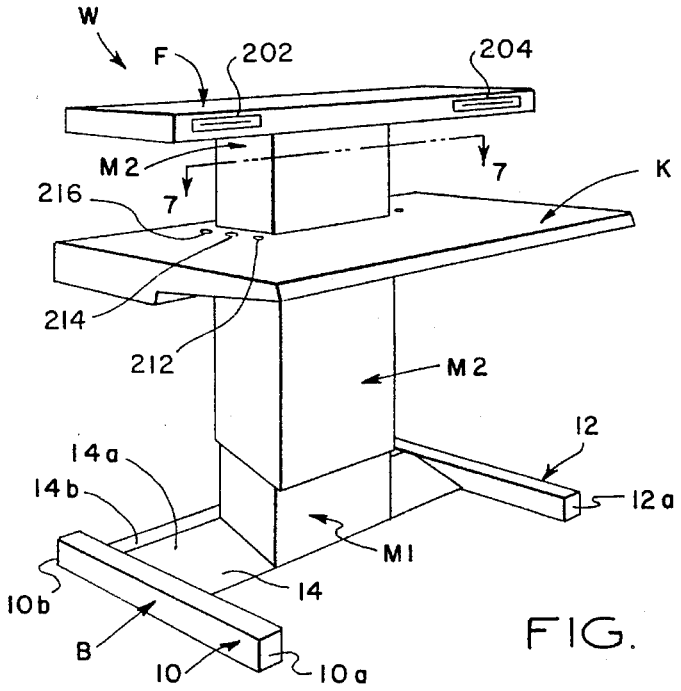
FIG. 3 is an elevational perspective view of the workstation of the present invention similar to that shown in FIG. 1 and FIG. 2, showing the monitor shelf and work surface in a fully extended, vertical position.

The monitor shelf F is adapted to be secured with the upper end surface 22*a* of the mast 22 of the second vertical mast M2 such that any vertical-movement of the second vertical mast M2 results in vertical movement of the monitor shelf F. The second vertical mast M2 is movable between a vertically extended position and a vertically retracted position, with the monitor shelf F being at its upper-most elevational position with respect to the base member B when the second vertical mast M2 is in the vertically extended position as best seen in FIG. 3. Furthermore, the monitor shelf F is in the lowermost elevational position when the second vertical mast M2 is in the vertically retracted position as shown (in FIG. 1 and FIG. 2), with the lower end surface 22*b* of the mast 22 of the second vertical mast M2 being in close proximity to the base member B when the second vertical mast M2 is in this vertically retracted position. In this vertically retracted position, the lower end surface 22*b* is in close proximity to the foot rest surface 14*a* of the cross member 14 of the base member B.

The workstation W of the present invention further includes a monitor shelf F which includes a shelf 26 (FIG. 4, FIG. 5) having an upper surface 26*a*, outer surfaces 26*b*, 26*c*, 26*d*, 26*e* and inner surfaces 26*f*, 26*g*, 26*h*, 26*i*. Preferably longitudinally extending guide rods 28, 30 are secured with the shelf 26 such that ends 28*a*, 30*a* of guide rods 28, 30 are secured with surface 26*f* of shelf 26, while ends 28*b*, 30*b* of rods 28, 30 are secured with surface 26*i* of shelf 26 of the monitor shelf F. The guide rod 28 is adapted to be received in bearing blocks 32, 34 which are mounted with surface 22*d* of mast 22 while guide rod 30 is mountable with bearing blocks 36, 38 which are secured to surface 22*e* of mast 22.

The monitor shelf F is mounted with the second vertical mast M2 for horizontal movement between an aft position and a fore position with respect to the longitudinal axis of the first vertical mast M2 and the aligned longitudinal axis of the second vertical mast M2. When the monitor shelf F is in a fore position, the surface 26i of shelf 26 is in close proximity and/or abutting to the outer surface 22*f* of the mast 22. When the monitor shelf F is in an aft position, surface 26*f* of shelf 26 is in close proximity and/or an abutting relation to the outer surface 22*c* of vertical mast 22 of the second vertical mast M2. As such, the monitor shelf F can be moved between such fore and aft positions. By properly selecting the bearing blocks 32, 34, 36, 38 with sufficient resistance to movement of the guide rods 28, 30 therein, any desired fore through aft position (after being determined) of the monitor shelf F may be maintained.

The workstation W of the present invention further includes illumination means I (FIG. 4) mounted with the monitor shelf F for illuminating the work surface K below the monitor shelf F. The illumination means I preferably includes a suitable light source 40, which may include a fluorescent lighting fixture or a variable intensity incandescent or halogen bulb such as with a dimming circuit (not shown), by way of example, which is mounted with surface 26*f* of the shelf 26 in a fashion to reduce, minimize or eliminate glare upon the computer monitor (not shown).

Figure 4:
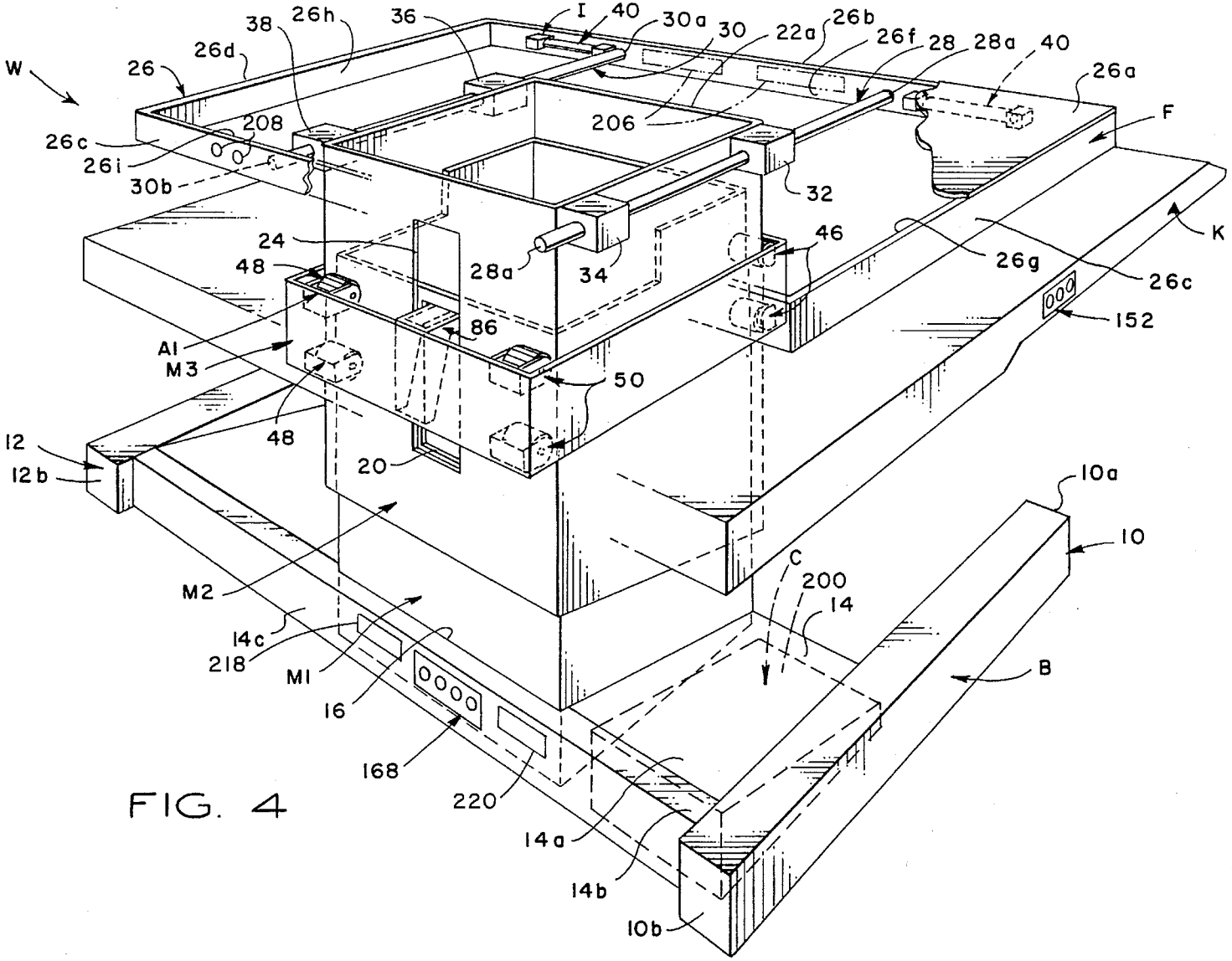
FIG. 4 is an elevational perspective view of the workstation of the present invention, partly in section and partly in phantom, showing details of the vertical masts.

The workstation W further includes a third vertical mast M3 disposed about the second vertical mast M2 for movement therewith and having a work surface K preferably secured thereto. As best seen in FIG. 4 and FIG. 6, the third vertical mast M3 includes a mast 42 having inner surfaces 42*a*, 42*b*, 42*c*, 42*d* (FIG. 7), outer surfaces 42*e*, 42*f*, 42*g*, 42*h*, an upper end surface 42*i* and a lower end surface 42*j*. First alignment means A1 is mounted with the third vertical mast M3 for ensuring aligned, vertical movement of the third vertical mast M3 with respect to the second vertical mast M2. The first alignment means A1 includes a plurality of bearing or roller members, such as roller members 44, 46 mounted with surface 42*a* of mast 42 and roller members 48, 50 mounted with surface 42*d* of mast 42. Each of the roller members 44, 46, 48, 50 may include a suitable mounting bracket such as that shown in FIG. 7 as including bracket member 50*a*, axle 50*b* and roller 50*c* mounted on axle 50*b* for rotation therewith. When the third vertical mast M3 is properly positioned about the second vertical mast M2, the roller members 44, 46, 48, 50 engage the outer surfaces 22*c*, 22*f* of mast 22 of the second vertical mast M2 for properly positioned movement of the third vertical mast M3 with respect thereto. As best seen in FIG. 4, each of the roller members 44, 46, 48, 50 may include pairs of rollers, with upper rollers being mountable near the upper end 42*i* of the mast 42 and the other, lower rollers being mountable adjacent the lower end surface 42*j* of the mast 42. Thus, in the preferred embodiment, the first alignment means A1 preferably includes eight separate roller assemblies for .ensuring proper aligned movement of the third vertical mast M3 with respect to the second vertical mast M2. Furthermore, it will be appreciated that the longitudinal axis of the third vertical mast M3 is aligned with that of the second vertical mast M2 and the first vertical mast M1.

Figure 7:
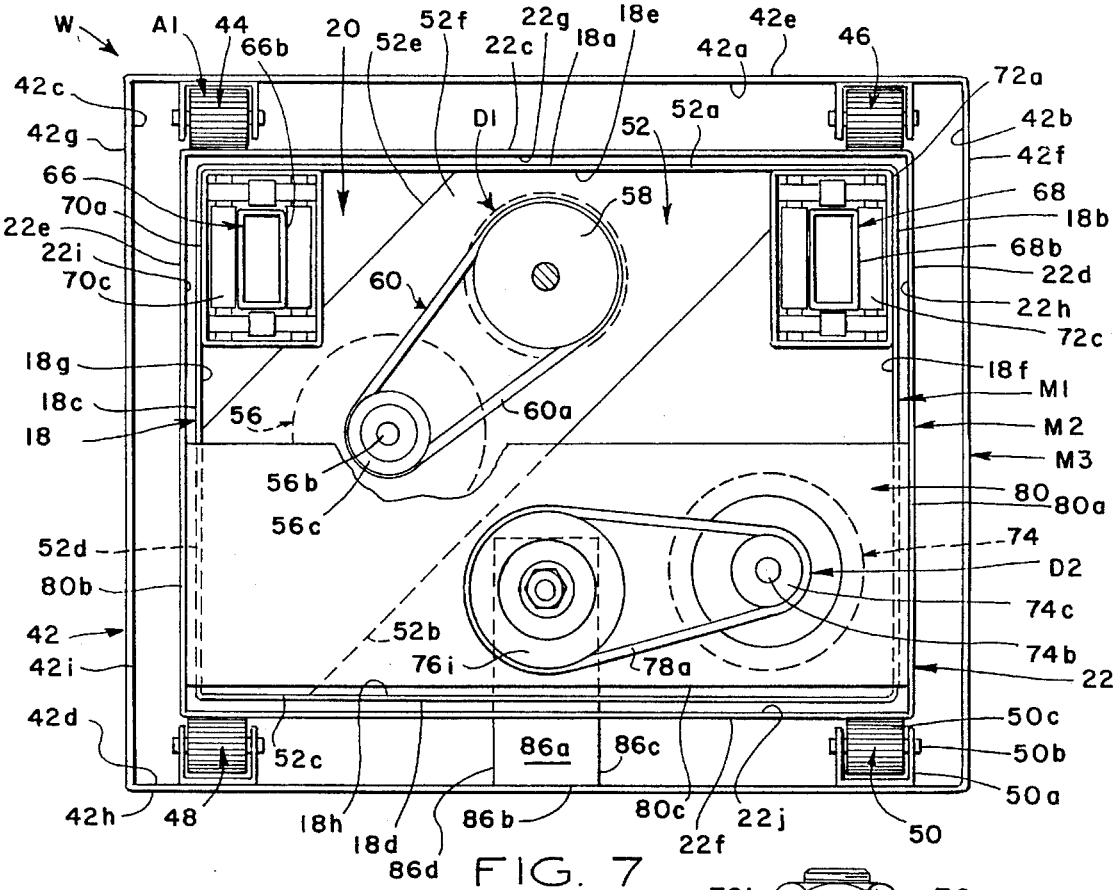
FIG. 7 is a plan view of the workstation of the present invention, partly in cutaway, taken along the lines 7—7 in FIG. 3, showing in part/details of the drive means and alignment means of the present invention.
Figure 8:
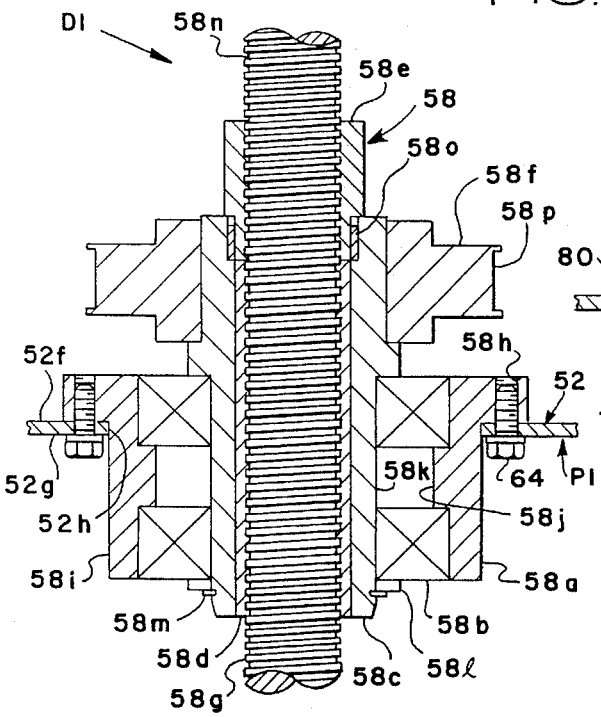
FIG. 8 is an enlarged, cross-sectional elevational view of the first drive member of the workstation of the present invention.

The workstation W of the present invention further includes drive means D for effectuating movement of the second vertical mast M2 and third vertical mast M3. More specifically, the drive means D includes a first drive member D1, a second drive member D2 and a third or tilt drive member D3. The first drive member D1 is best seen in FIGS. 5, 7 and 8 and is used for driving the second vertical mast M2 between the vertically extended position (FIG. 3) and the vertically retracted position (FIG. 1). The first drive member D1 is adapted to be secured with the workstation W of the present invention by a plate member P1 which includes plate 52 having edge surfaces 52*a*, 52*b*, 52*c*, 52*d* and 52*e*, as best seen in FIG. 7. Preferably, edge surface 52*a* of plate 52 is secured with inner surface 18*e* of mast 18 of the first vertical mast M1, with edge surface 52*c* joining surface 18*h* and surface 52*d* joining surface 18*g* for the secure mounting of the plate 52 with the mast 18. The plate 52 further includes an upper surface 52*f* and a lower surface 52*g*. As best seen in FIG. 8, an opening 52*h* is formed in plate 52 for receiving a portion of the first drive member D1. The first drive member D1 is mounted with the first vertical M1 for providing power for vertical movement of the second vertical mast M1 between the vertically extended position and the vertically retracted position. The first drive member D1 includes a motor 56, shaft member 58 and engaging mechanism 60. Preferably, the plate 52 is formed having suitable openings permitting the mounting of the motor 56 therewith in such a fashion that the face 56*a* of the motor 56 engages surface 52*g* of plate 52. The motor 56 is secured to plate 56 by suitable fasteners 62 that extend between surfaces 52*f* and 52*g* of the plate 52 for securing the motor 56 therewith. As mounted, the drive shaft 56*b* of the motor 56 extends upwardly through plate 52, having a suitable pulley hub 56*c* mounted therewith, with the motor 56 powering the pulley hub 56*c* for clockwise and counter-clockwise rotation.

As best seen in FIG. 8, the shaft member 58 includes shaft housing 58*a*, bearings 58*b*, sleeve 58*c*, threaded section 58*d*, collar 58*e*, pulley hub 58*f*, and threaded rod 58*g*. The shaft housing 58*a* is mounted with plate 52 by suitable fasteners 64 extending through plate 52 into threaded opening 58*h* formed in the shaft housing 58*a*, with the outer surface 58*i* of the shaft housing 58*a* being received within opening 52*h* formed in plate 52. Suitable bearings 58*b* are interposed between the inner annular surface 58*j* of the shaft housing 58*a* and the outer annular surface 58*k* of sleeve 58*c*, with suitable thrust ring 581 and locking clip 58*m* lockably securing the bearings 58*b* in their proper relationship between the shaft housing 58*a* and sleeve 58*c*. The threaded portion 58*d* and collar 58*e*, each having compatibly formed threaded interior bores for receiving compatibly formed threads 58*n* formed on threaded rod 58*g*, are secured with the shaft member 58 by means of key member 58*o*.

As such, the pulley hub 58*f* is adapted to receive belt 60*a* of the engaging means 60 on surface 58*p* formed with the pulley hub 58*f*. The belt 60*a* of the engaging means 60 extends between the pulley hub 56*c* of the motor 56 and the pulley hub 58f of the shaft member 58 such that powered rotation of the pulley hub 56*c* results in rotation of the pulley hub 58*f*. Powered rotation of the pulley hub 58*f* results in rotation of the sleeve 58*c* and collar 58*e*, thus resulting in vertical movement of the threaded rod 58*g* either upwardly or downwardly with respect to the plate 52. As best seen in FIG. 5, the threaded rod 58*g* has an engaging foot 58*q* which is adapted to bear upon lower surfaces 26*j* of shelf 26. Any vertical movement of the threaded rod 58*g* results in corresponding vertical movement of the mast 22 of the second vertical mast M2 and the shelf 26 of the monitor shelf F. As such, the first drive member D1 provides power for the vertical movement of the second vertical mast M2 and monitor shelf F between the vertically extended position (FIG. 3) and the vertically retracted position (FIG. 1).

The workstation W of the present invention further includes second alignment means A2 for permitting aligned movement of the second vertical mast M2 with respect to the first vertical mast M1. The second alignment means A2, as best seen in FIGS. 5 and 7, includes vertical rails 66, 68 and restraining members 70, 72 mounted within the first vertical mast M1 for engaging the outer surface of the vertical rails 66, 68 for permitting aligned vertical movement of the second vertical mast M2 with respect to the first vertical mast M1. Preferably, rails 66, 68 are of a generally rectangular cross-section and are secured with lower surface 26*j* of shelf 26 at upper ends 66*a*, 68*a*, respectively, by suitable fasteners (not numbered).

The vertical rails 66, 68 extend downwardly from the lower surface 26*j* of shelf 26 in substantial parallel alignment with the vertical axes of the vertical masts M1, M2, M3, however, not coaxial therewith. Vertical rail 66 of alignment means A2 is received in vertically aligned bearing blocks 70*a*, 70*b* of restraining member 70 that are mounted adjacent the corner formed by surfaces 18*e*, 18*g* of the mast 18 of the vertical mast M1. Preferably, suitable bearings 70*c* are mounted with the bearing blocks 70*a*, 70*b* for engaging the outer surface 66*b* of vertical rail 66. In like fashion, vertical rail 68 extends downwardly from surface 26*j* of the shelf 26 and is received within vertically aligned bearing blocks 72*a*, 72*b* mounted within the first vertical mast M1 adjacent the corner formed by surfaces 18*e*, 18*f* of the mast 18. Similarly, bearings 72*c* are mounted with the bearing blocks 72*a*, 72*b* of the restraining members 72 for engaging the outer surface 68*b* of the vertical rail 68.

As noted above and shown in the drawings, the vertical rails 66, 68 are of a substantially rectangular cross-section and accordingly, the bearings 70*c*, 72*c*, including a plurality of roller members mounted within first vertical mast M1, are designed to engage each of the exterior, flat surfaces of the vertical rails 66, 68. However, it will be appreciated that any other suitable cross-sectional configuration may be used for such vertical rails 66, 68 (i.e., circular, square, etc.) and the bearings 70*c*, 72*c* may be sized to properly engage the exterior surface in a secure fashion to permit aligned vertical movement therewith. Thus, the restraining members 70, 72 engage the outer surface of the vertical rails 66, 68 permitting aligned vertical movement of the second vertical mast M2 with respect to the first vertical mast M1. As such, this second alignment means A2 helps to prevent unwanted shifting and/or wobbling of the monitor shelf F either when the monitor shelf F is stationary and/or being moved between the vertically extended and retracted positions.

The workstation W of the present invention includes a second drive member D2 for vertically driving the third vertical mast M3 between an upper position and lower position, with the work surface K being at its highest elevational position when the third vertical mast M3 is in the upper position and the work surface K at its lowest elevational position when the third vertical mast M3 is in the lower position. The second drive means D2 is secured with the second vertical mast M2 for providing power for vertical movement of the third vertical mast M3 between the upper position and lower position.

Figure 9:
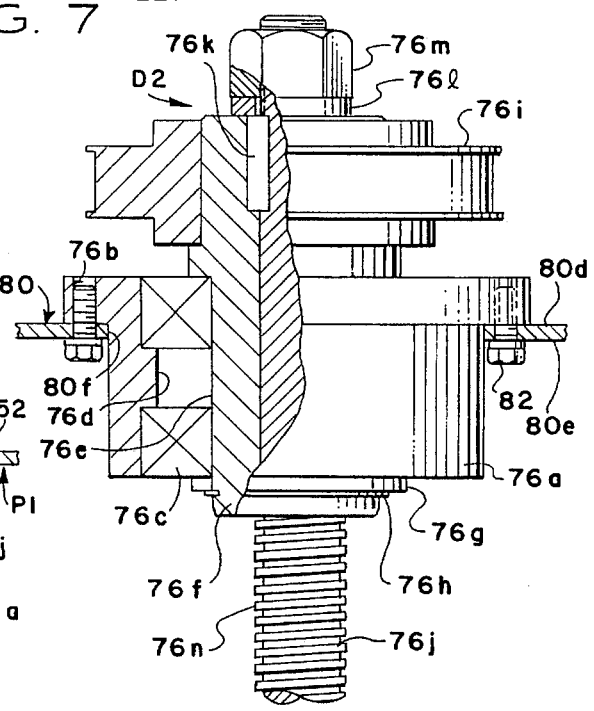
FIG. 9 is an enlarged, partly in section, elevational view of the second drive member of the workstation of the present invention.

The second drive means D2 includes a motor 74, shaft member 76 and engaging means 78. The motor 74 is mounted with the second vertical mast M2 via plate 80 (FIGS. 6, 7 and 9). Plate 80 is secured with surfaces 22*h*, 22*i* of mast 22 via end surfaces 80*a*, 80*b*, respectively, of plate 80, with surface 80*c* being in close proximity to surface 22*j* of mast 22. The plate 80 further has an upper surface 80b and a lower surface 80*e*. The motor 74 is mounted with the plate 80 such that the face 74*a* of the motor 74 abuts the lower surface 80*e* of the plate 80 and is secured thereto with suitable fasteners (not shown). The drive shaft 74*b* of the motor 74 extends through the plate 80 and above the upper surface 80*d*, with a pulley hub 74*c* being affixed to the drive shaft 74*b* for powered rotation thereof.

Engaging means 78, including belt 78*a*, permits the motor to driveably engage shaft member 76 to effectuate vertical movement of the third vertical mast M3 between upper and lower positions. More specifically, the shaft member 76 (FIG. 9) includes a shaft housing 76*a* which is adapted to be received within a suitable opening 80*f* formed in plate 80, with the shaft housing 76*a* being secured thereto by suitable fasteners 82. The fasteners 82 are threadedly received in compatibly formed threaded openings 76*b* formed in shaft housing 76*a*. Bearings 76*c* are disposed between the inner annular surface 76*d* of the shaft housing 76*a* and the outer annular surface 76*e* of the sleeve 76*f*, with suitable thrust ring 76*g* and locking ring 76*h* properly maintaining the bearings 76*c* in their respective proper relationship between the shaft housing 76*a* and the sleeve 76*f*. The shaft member 76 further includes a pulley hub 76*i* secured with sleeve 76*f*, with the sleeve 76*f* being in a fixed relationship with respect to threaded rod 76*j* by means of key 76*k*. The thrust washer 761 and nut 76*m* permit securing of the pulley hub 76*i*, key 76*k* and sleeve 76*f* with the threaded shaft 76*j*. Rotation of the pulley hub 76*i* results in comparable rotation of threaded rod 76*j*, with such rotation of the pulley hub 76*i* being effectuated by virtue of powered movement of the draft shaft 74*b* of the motor 74 as translated thereto by means of the belt 78*a* of engaging means 78.

As best seen in FIG. 6, the threaded rod 76*j* extends downwardly from the shaft member 76 and plate 80 and is received in a collar 84 having a threaded bore which is compatible with that of the threads 76*n* formed on the exterior of the threaded rod 76*j*. The collar 84 is mounted with a support arm 86. The support arm 86 preferably has a horizontally extending upper surface 86*a*, a vertical surface 86*b*, and side surfaces 86*c*, 86*d*, which together cooperate to form the angled support arm 86. The horizontal surface of 86*a* of the support arm 86 extends through cavities 20, 24 in masts 18, 22 of the first and second vertical masts M1, M2. The surface 86*b* is preferably secured with surface 42*d* of mast 42 of the third vertical mast M3, with the upper surface 86*a* of the support arm 86 extending outwardly therefrom so as to support collar 84 in a vertically aligned position beneath the shaft member 76 of the second drive means D2. Thus, rotation of the threaded rod 76*j* of the shaft member 76 as extending through collar 84 results in movement of the support arm 86 either upwardly or downwardly in response to rotation (either clockwise or counter-clockwise) of the threaded rod 76*j*. As the support arm 86 is affixed with the third vertical mast M3, movement of the support arm 86 vertically upwardly or downwardly results in comparable aligned movement of the third vertical mast M3 as properly aligned by the first alignment means A1.

The workstation W of the present invention further includes tilt means T for tilting the work surface K between a substantially horizontal position 88 (FIG. 11) and a tilted position 90 shown in phantom. The horizontal position is substantially perpendicular to the longitudinal axis of the vertical masts M1, M2, M3, with the titled position 90 being where the work surface K is at an angle with respect to the horizontal. Ergonomic studies have indicated that preferred tilt positions with respect to the horizontal should be no greater than 15 degrees. The tilt means T is used for tilting the work surface K. The work surface K includes the work surface 92 having an upper surface 92*a*, a lower surface 92*b*, a front edge surface 92*c*, end surfaces 92*d*, 92*e*, rear surface 92*f*, 92*g*, and interior opening surfaces 92*h*, 92*i*, 92*j*. Preferably, the third vertical mast M3 is mounted with the interior opening surfaces 92*h*, 92*i*, 92*j* adjacent upper surface 42*i* of mast 42 (FIG. 6). Pivot members 94, 96 are mounted with the lower surface 92*b* of the work surface 92 by suitable fasteners 98. The pivot members 94, 96 preferably are formed having a horizontal bore 94*a*, 96*a* formed therethrough for receiving a pivot rod 100 therein. The rod 100 is adapted to be fixed with the third vertical mast M3 such that the work surface 92 may tiltably pivot about such rod 100. It should be noted that the pivot members 94, 96 are positioned substantially at the center point of balance for the work surface 92 of the work surface K for minimizing tilt forces required in order to effectuate tilting action of the work surface K, as discussed more fully hereinbelow. The tilt means T of the present invention further includes a tilt motor 102 having a motor face 102*a* and drive shaft 102*b*. The motor face 102*a* is secured with flange member 104 by fasteners 106, with the motor face 102*a* engaging surface 104*a* of the flange member 104. Preferably, an opening 104*b* is formed in the flange member 104 for receiving the collar 102*c* and drive shaft of motor 102, with the opening 104*b* appropriately sized for receiving collar 102*c* and the drive shaft 102*b* preferably extending beyond surface 104*c* of flange member 104.

Figure 14:
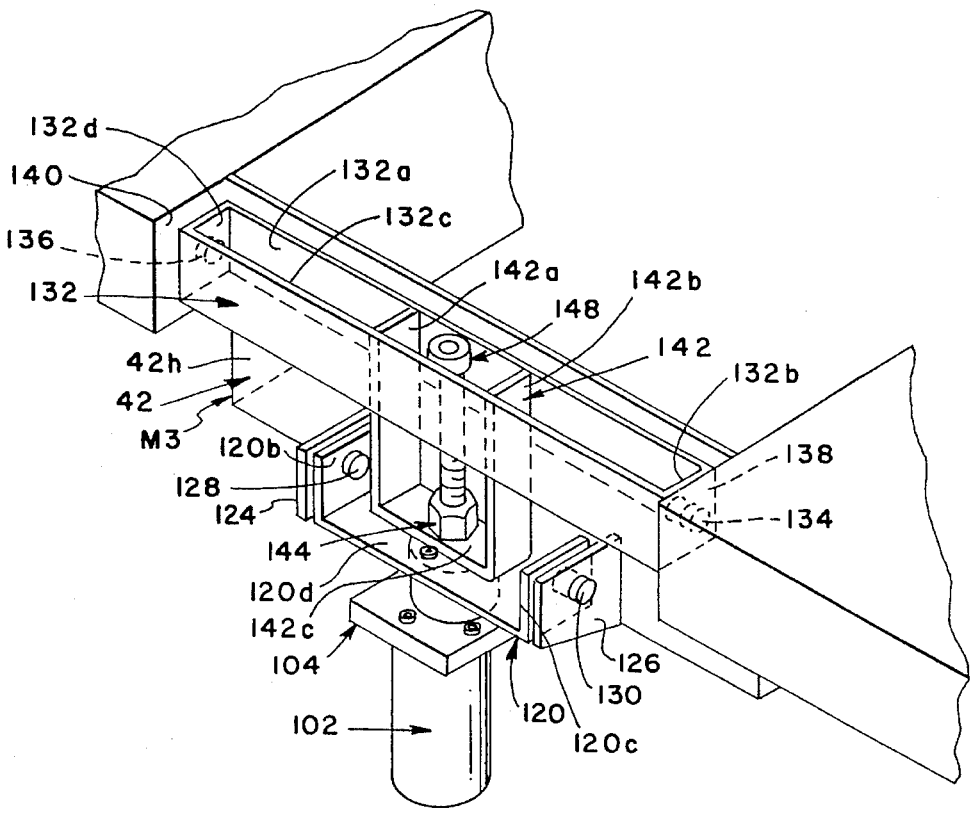
FIG. 14 is an enlarged perspective view of the tilt means of the workstation of the present invention; and, FIG. 15 is a side, elevational view, partly in section, of the work surface as tilted by the tilt means of the workstation of the present invention.
Figure 15:
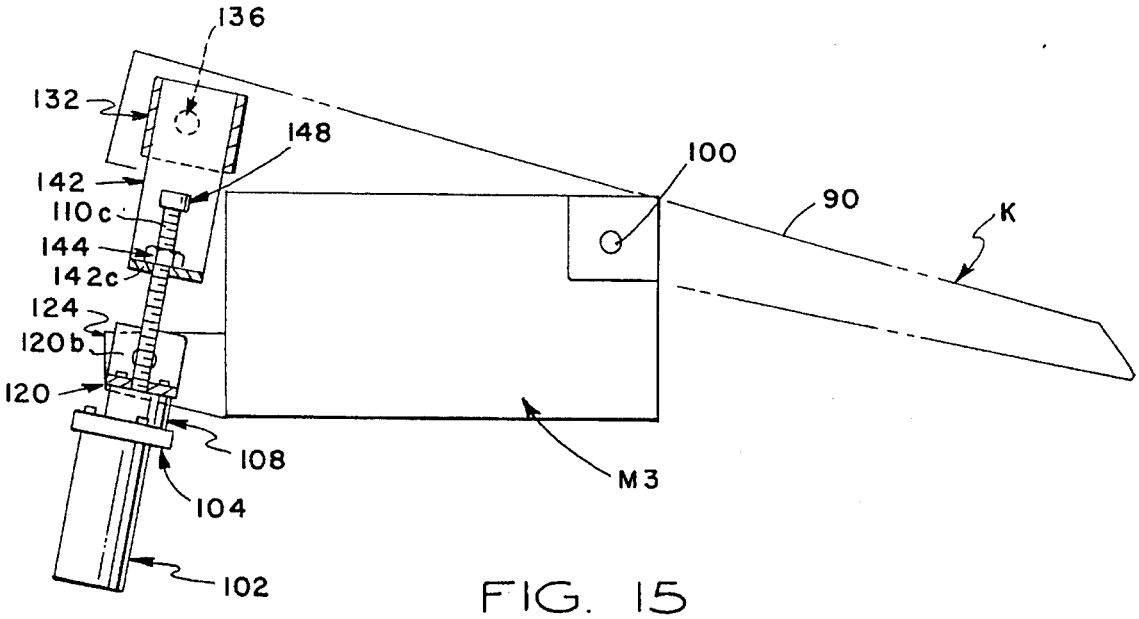

A bearing housing 108 is secured with the flange member 104 adjacent surface 104*c*, with the housing 108 being formed having an inner annular surface 108*a*. A drive member 110 is positioned within the inner annular surface 108*a* in mating engagement with the drive shaft 102*b* of the motor 102 by virtue of a bore 110*a* receiving drive shaft 102*b* with a suitable key member 112 securing the drive member 110 with the drive shaft 102*b*. Suitable bearings 114 are disposed between the inner annular surface 108*a* of the housing 108 and the outer annular surface 110*b* of the drive member 110. The drive member 110 is secured with the housing 108 by locking ring 116 acting through thrust washer 118. Preferably, the drive member 110 is formed having a threaded shaft 110*c* that is in substantial axial alignment with the bore 110*a* and drive shaft 102*b* of the motor 102. Thus, rotation of the drive shaft 102*b* results in rotation of the shaft 110*c*. The housing 108 preferably is mounted with plate 120 by suitable fasteners 122 such that the drive member 110 extends through opening 120*a* formed in plate 120, having two end flanges 120*b*, 120*c* that are substantially perpendicular from the horizontal surface 120*d*. Motor supports 124, 126 are secured with outer surface 42*h* of mast 42 of the third vertical mast M3. Pivot pins 128, 130 extending between motor supports 124, 126 and flanges 120*b*, 120*c*, respectively, allow for the pivotal mounting of the motor 102 - plate 120 combination with respect to the third vertical mast M3 (FIG. 14). A support box 132 having sides 132*a*, 132*b*, 132*c* and 132*d* is pivotally mounted with the work surface 92 by virtue of pivot pins 134,136 extending from surfaces 132*b*, 132*d*, respectively, through suitably formed openings in support blocks 138, 140, respectively, which are in turn secured with the work surface 92 adjacent end surfaces 92*g*, 92*f*, respectively. Preferably, a U-shaped member 142 having sides 142*a*, 142*b* and a base 142*c* is secured with the support box 132 such that sides 142*a*, 142*b* are substantially perpendicular to and extend between sides 132*a*, 132*c* of the support box 132. As shown in FIGS. 14–15, the shaft 110*c* of the drive member 110 extends through a suitably formed opening (not numbered) in base 142*c* of the U-shaped member 142 and extends upwardly therefrom with a threaded member 144 threadedly receiving the shaft 110*c*, the threaded member 144 being fixedly secured with base 142*c* of the U-shaped member 142. Stop nut 148 mounted with shaft 110*c* prevents unthreading of the shaft 110*c* from the threaded member 144.

Figure 11:
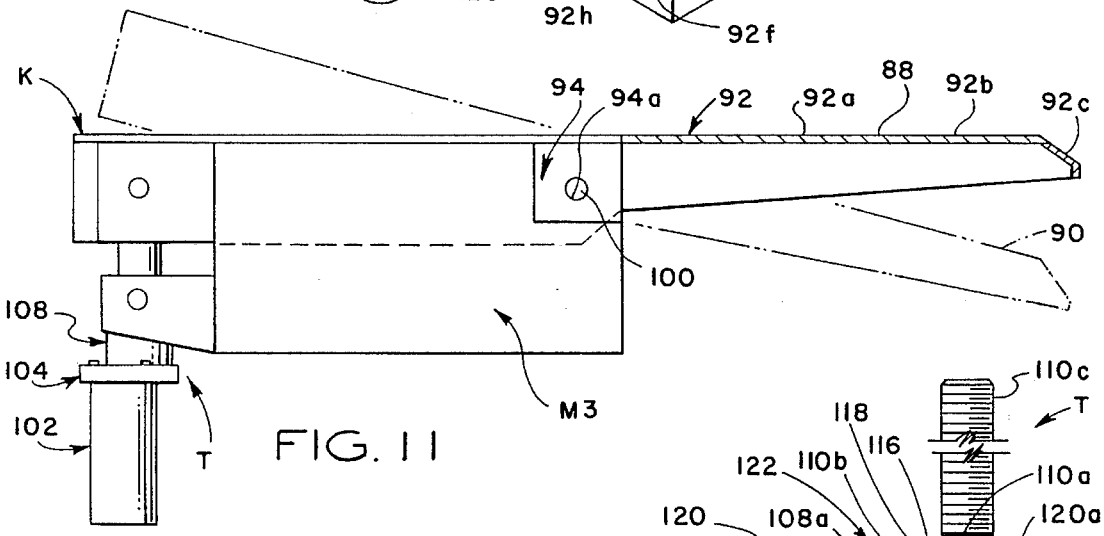
FIG. 11 is a side, elevational view, partly in section, showing the titling capabilities of the work surface of the workstation of the present invention.

The tilt means T of the workstation W of the present invention responds with tilting movement of the work surface K upon actuation of motor 102 resulting in ultimate rotation of shaft 110*c*. Rotation of the shaft 110*c* in cooperation and in threaded engagement with threaded member 144 results in the U-shaped member 142 and support box 132 to move from the substantially horizontal position 88 as shown in FIG. 11 to that of a tilted position 90 as shown in FIG. 11 and FIG. 15. As shown in FIG. 1 and FIG. 3, the work surface K is in a substantially horizontal position. Actuation of the motor 102, shaft 110*c* combination results in upward urging of the U-shaped member 142 and support box 132 as shaft 110*c* rotates. Pivot pins 128, 130 permit the motor 102 to pivot from a substantially vertical position to an off-vertical position as the work surface K travels from a horizontal position 88 to a tilted position 90. Similarly, pivot pins 134, 136 permit a like tilting action of the support box 132 in response to the upward urging caused by rotation of the shaft 110*c* acting on threaded member 144. As such, the support box 132 and plate 120 cooperate to provide aligned tilting action of the tilt motor 102 during tilting operations of the workstation W of the present invention.

The workstation W of the present invention is adapted to have personal computer monitors and/or central processing units (not shown) mounted on the monitor shelf F and/or having such mounted on the work surface K. Typically, such devices all require electrical power. In order to provide a neat, clean appearance for the workstation W of the present invention, it is preferred that electrical power outlets 168 (FIG. 4) be mounted with the surface 14*c* of base 14 of base member B of the present invention to provide all necessary electrical requirements for those utilizing the workstation W of the present invention in a working environment.

Figure 13:
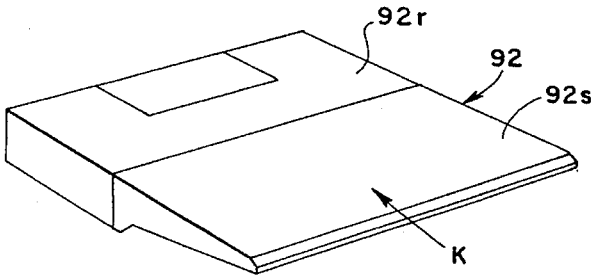
Figure 12:
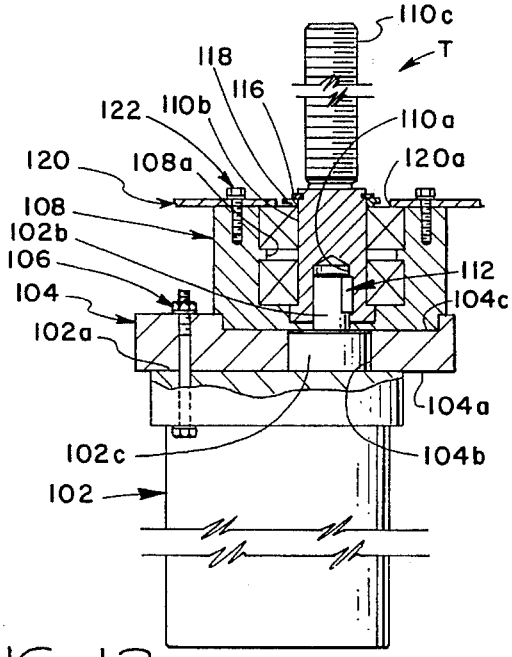
FIG.12 is an elevational, sectional view of a portion of the tilt means of the workstation of the present invention; alternative embodiment of the work surface of the workstation of the present invention.

As best seen in FIG. 13, the work surface K of the workstation W may be of a split tilt design; that is, with the work surface 92 being split into two portions, namely a mast member portion 94*r* and a separately, tiltable member portion 92*s*. In such a configuration, the mast member portion 92*r* is adapted for coordinated movement with the third vertical mast M3 and tiltable therewith as described hereinabove, while the tiltable member portion 92*s* is adapted to tilt independently of mast member portion 92*r*. This configuration would be of particular utility should it be necessary for various components of the personal computer system to be placed upon the mast member portion 92*r* of the work surface 92 of the work surface K, yet providing a tiltable member portion 92*s* capable for tilting action to meet the demands of the user.

Figure 10:
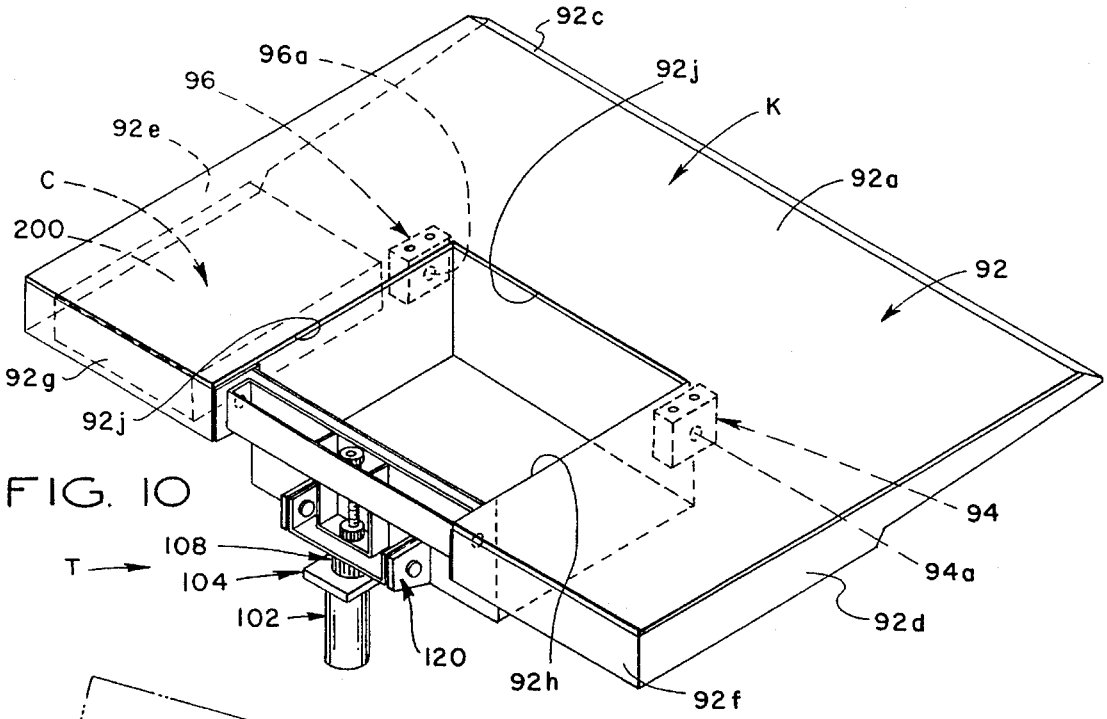
FIG. 10 is an elevational perspective view of the work surface of the workstation of the present invention.

The workstation W of the present invention further includes computer means C mounted therewith for providing the necessary computing functions. For example, the computer means C may be useful in running programs relating to computer aided design and/or computer aided manufacturing, for which the workstation W is particularly well-suited. The computer means C preferably includes a central processing unit 200, which is known in the art to include items such as a power supply, mother board, and various hard drives (not shown). Preferably, power for the central processing unit 200 is available from power source (not shown) that is tied in with electrical power outlets 168. The central processing unit 200 of the computing means C may be mounted with the workstation W at the lower end of the first mast M1 (as shown in FIGS. 1, 5), within the base member B (as schematically shown in FIG. 4), or within the work surface (as schematically shown in FIG. 10), as may be desired. The computing means C may further be connected to disk drives 202 and 204 preferably mounted with surfaces 26*b*, 26*f* of the monitor shelf 26 of the monitor shelf F. As seen in FIG. 4, for example, the disk drives 202, 204 may be positionable with the monitor shelf F in the same position as the illumination means I so as to provide suitable for and aft movement of the monitor shelf F without interfering with the disk drives 202, 204. In such a situation, the illumination means I may be repositioned between rails 28, 30 adjacent a suitable stop (not shown) to prevent contact between such moved illumination means I and the mast M2. The repositioning of the illumination means I is best seen by the phantom lines designated as 206 in FIG. 4. Preferably suitable monitor connectors 208 (FIG. 4) are mounted with surfaces 26*c*, 26*i* of the shelf 26 of the monitor shelf F in order for providing suitable connection to a display monitor or monitors (not shown) adapted to be positioned atop the monitor shelf F.

Furthermore, the computing means C further is electrically connected to suitable input ports 212, 214 and 216 mounted with the upper surface of the work surface K (as best seen in FIGS. 3, 6) for connecting same to various import components, such as a keyboard (not shown), a mouse (not shown), and/or any other type of digitizer or suitable "add on" component (not shown) for use with the computing means C of the present invention. The computer means C of the present invention further connected to output ports 218, 220 (FIG. 4), preferably positioned adjacent to electrical outlets 168, with such output ports 218,220 adapted to be connected to output components, such as printers, plotters or the like (none shown) that may be driven by the computing means C of the present invention. All of the various components of the computing means C, such as the central processing unit 200, and the attached components, such as the disk drives 202, 204, the ports, 208, 212, 214, 216, 218, 220 are all electrically connected (not shown) as is well known in the art so as to cooperate and operate together as a singular computing unit.

In the use or operation of the fully-integrated workstation W of the present invention, a user would ordinarily position oneself in a sitting position before the workstation W. For example, as shown in FIG. 1, the user's feet would be placed upon foot surface 14*a*. Thereafter, by activating suitable electrical switches 152 (FIG. 4) mounted with work surface K (however, such may be mounted at any convenient place on the workstation W), the user may elect to adjust the tilt of the work surface K by energizing motor 102, thus meeting the user's preference with respect to such. By the user energizing motor 56, the elevation of the monitor shelf F is adjusted to suit that of the user. Vertical movement of the monitor shelf F results in vertical movement of the work surface K, which can thereafter be suitably adjusted to the user's preference by appropriately energizing motor 74, thus defining a particular vertical distance relationship between the monitor shelf F and the work surface K. Also the user may elect to energize the illumination means I for providing shielded, glare-free illumination upon the work surface K and/or monitor (not shown). Should the user tire of sitting, the user may then by energizing motor 56 result in vertical movement of the second vertical mast M2 and monitor shelf F vertically upward, resulting in combined vertical movement of the monitor shelf F and work surface K. As the original relationship between the monitor shelf F and the work surface K was established from a sitting position, it is unlikely any additional adjustment need be made as this relationship typically will remain the same for each particular user whether the user is standing or sitting. Nonetheless, should the user elect to thereafter adjust the vertical relationship between the monitor shelf F and the work surface K, the user need only energize motor 74 which will result in appropriate vertical movement of the third vertical mast M3 and associated work surface K.

It should be appreciated that the selection and positioning of the pivot members 94, 96 are at the substantial central point of the work surface K of the workstation W of the present invention. As such, by pivoting the work surface K about such pivot points, the amount of front surface 92*c*, rear surfaces 92*g*, 92*f* arcuate movement is minimized while also reducing the power requirements necessary for motor 102 in order to effectuate a tilting operation, as the force required to tilt the work surface K is effectively minimized.

Thus, the fully-integrated workstation W of the present invention provides for separate, independently adjustable vertical positioning of the monitor shelf F and work surface K, that may easily accommodate sitting or standing positions of the user. Furthermore, the monitor shelf F adjusts horizontally along guide rods 28, 30 to provide optimum eye to display distances for the user. Further, the workstation W of the present invention provides a work surface K that is capable of tilting to the desires of the user between optimum tilt distances preferably of zero to 15 degrees. Furthermore, the illumination means I of the workstation W of the present invention helps to eliminate glare on the monitor as the monitors typically would be placed above on the monitor shelf F while the illumination means I provides light below to the work surface K. Furthermore, the monitor shelf F acts to shade a monitor display from the illumination means I.

Furthermore, the fully-integrated workstation W of the present invention includes a complete computing means C for allowing the user complete access to all necessary and required computing capabilities, with such being fully-integrated into the workstation W of the present invention. As such, the central processing unit 200 is fully housed within the workstation W with the disk drives 202, 204 and other components connected to the computing means C being positioned in such a matter so as to provide ease of access to the user.

Thus, the fully-integrated workstation W of the present invention contemplates ease of adjustment for the user for individual preferences. The user can adjust any of the essential vertical or tilt variables without leaving the workstation W or requiring any particular tools, skills or strengths. Adjustments are quickly made from sitting to standing positions of the user and back again. Furthermore, given the electrically powered drives acting through threaded members, even the slightest incremental adjustments are capable and easily available for the user, with each position being locked in place after activation. Thus, separate and full range of adjustment permit maintenance of proper eye to display line of sight and horizontal distance positioning, input device height and angle, and glare-free intensity adjustable work environment combined into a single compact workstation.

Various embodiments of the invention have now been described in detail. Since many changes in and additions to the above-described preferred embodiment may be made without departing from the nature, spirit and scope of the invention, the invention is not to be limited to such details, except as set forth in the appended claims.

What is claimed is:

1. A workstation comprising:

a base member;

a first vertical mast formed having an exterior surface and having a first vertical longitudinal axis, said first vertical mast being mounted with said base member and extending upwardly therefrom to an upper end;

a second vertical mast formed having an interior perimeter surface and an outer perimeter surface, said interior perimeter surface being positioned about said exterior surface of said first vertical mast, said second vertical mast having a second vertical longitudinal axis, said second vertical mast being vertically movable with respect to said first vertical mast;

a monitor shelf carried by said second vertical mast for movement therewith;

a third vertical mast formed having an inner surface, said inner surface being positioned about said outer perimeter surface of said second vertical mast, said third vertical mast having a third vertical longitudinal axis, said third vertical mast being vertically movable with respect to said second vertical mast;

a work surface mounted with said third vertical mast for movement therewith, said work surface being selectively positioned below said upper end of said first vertical mast; and computing means mounted within said first vertical mast for providing selective computing capabilities.

2. The workstation of claim 1, wherein:

said computing means includes a central processing unit mountable with the lower end of said first vertical mast adjacent said base member.

3. The workstation of claim 1 wherein:

said computing means is connected to at least one disk drive mounted with said monitor shelf.

4. The workstation of claim 3, wherein:

said disk drive is mountable with said monitor shelf adjacent an outer surface of said monitor shelf.

5. The workstation of claim 1, wherein:

at least one monitor connector is mounted with said monitor shelf.

6. The workstation of claim 1, wherein:

said computing means is connected to at least one input port mounted with said work surface, said input port for connecting said computing means with an input component.

7. The workstation of claim 1, adapted to supportably receive a computer monitor, wherein:

said computing means is connected to at least one monitor port mounted with said monitor shelf for connecting said computing means with the computer monitor.

8. The workstation of claim 1, wherein:

said computing means is connected to at least one output port mountable with said base member for connecting the computing means to an output component.

9. A workstation comprising:

a base member;

a first vertical mast mounted with said base member and extending upwardly therefrom to an upper end;

a second vertical mast formed having a cavity therein, said second vertical mast receiving said first vertical mast within said cavity for vertical movement of said second vertical mast with respect to said first vertical mast;

a monitor shelf carried by said second vertical mast for movement therewith;

a third vertical mast formed having an inner surface opening, said third vertical mast receiving said second vertical mast within said inner surface opening for vertical movement of said third vertical mast with respect to said second vertical mast;

a work surface mounted with said third vertical mast for movement therewith, said work surface being selectively positioned below said upper end of said first vertical mast; and, computing means mounted within said first vertical mast for providing selective computing capabilities.

10. The workstation of claim 9, wherein:

said computing means includes a central processing unit mountable with the lower end of said first vertical mast adjacent said base member.

11. The workstation of claim 9 wherein:

said computing means is connected to at least one disk drive mounted with said monitor shelf.

12. The workstation of claim 11, wherein:

said disk drive is mountable with said monitor shelf adjacent an outer surface of said monitor shelf.

13. The workstation of claim 9, wherein:

at least one monitor connector is mounted with said monitor shelf.

14. The workstation of claim 9, wherein:

said computing means is connected to at least one input port mounted with said work surface, said input port for connecting said computing means with an input component.

15. The workstation of claim 9, adapted to supportably receive a computer monitor, wherein:

said computing means is connected to at least one monitor port mounted with said monitor shelf for connecting said computing means with the computer monitor.

16. The workstation of claim 9, wherein:

said computing means is connected to at least one output port mountable with said base member for connecting the computing means to an output component.

17. A workstation comprising:

a base member;

a first vertical mast mounted with said base member and extending upwardly therefrom to an upper end;

a second vertical mast formed having a cavity therein, said second vertical mast receiving said first vertical mast within said cavity for vertical movement of said second vertical mast with respect to said first vertical mast;

a monitor shelf carried by said second vertical mast for movement therewith;

a third vertical mast formed having an inner surface opening, said third vertical mast receiving said second vertical mast within said inner surface opening for vertical movement of said third vertical mast with respect to said second vertical mast;

a work surface mounted with said third vertical mast for movement therewith, said work surface being selectively positioned below said upper end of said first vertical mast; and, computing means mounted within said base member for providing selective computing capabilities.

18. The workstation of claim 17, wherein:

said computing means includes a central processing unit mountable within said base member adjacent the lower end of said first vertical mast.

19. The workstation of claim 17 wherein:

said computing means is connected to at least one disk drive mounted with said monitor shelf.

20. The workstation of claim 19, wherein:

said disk drive is mountable with said monitor shelf adjacent an outer surface of said monitor shelf.

21. The workstation of claim 17, wherein:

at least one monitor connector is mounted with said monitor shelf.

22. The workstation of claim 17, wherein:

said computing means is connected to at least one input port mounted with said work surface, said input port for connecting said computing means with an input component.

23. The workstation of claim 17, adapted to supportably receive a computer monitor, wherein:

said computing means is connected to at least one monitor port mounted with said monitor shelf for connecting said computing means with the computer monitor.

24. The workstation of claim 17, wherein:

said computing means is connected to at least one output port mountable with said base member for connecting the computing means to an output component.

25. A workstation comprising:

a base member;

a first vertical mast mounted with said base member and extending upwardly therefrom to an upper end;

a second vertical mast formed having a cavity therein, said second vertical mast receiving said first vertical mast within said cavity for vertical movement of said second vertical mast with respect to said first vertical mast;

a monitor shelf carried by said second vertical mast for movement therewith;

a third vertical mast formed having an inner surface opening, said third vertical mast receiving said second vertical mast within said inner surface opening for vertical movement of said third vertical mast with respect to said second vertical mast;

a work surface mounted with said third vertical mast for movement therewith, said work surface being selectively positioned below said upper end of said first vertical mast; and, computing means mounted within said work surface for providing selective computing capabilities.

* * * * *